US005833021A

United States Patent [19]

Mensa-Wilmot et al.

[11] Patent Number: 5,833,021

[45] Date of Patent: Nov. 10, 1998

[54] SURFACE ENHANCED POLYCRYSTALLINE DIAMOND COMPOSITE CUTTERS

[75] Inventors: Graham Mensa-Wilmot, Houston, Tex.; Ghanshyam Rai; Madapusi K. Keshavan, both of Sandy, Utah; David Truax, Houston; Kuttaripalayam T. Kembaiyan, Woodlands, both of Tex.

[73] Assignee: Smith International, Inc., Houston, Tex.

[21] Appl. No.: 615,860

[22] Filed: Mar. 12, 1996

[51] Int. Cl.[6] ..... E21B 10/46

[52] U.S. Cl. ..... 175/433; 51/295; 175/434

[58] Field of Search ..... 175/434, 428, 175/433; 51/295, 309, 293

[56] References Cited

U.S. PATENT DOCUMENTS

| | | | |
|---|---|---|---|
| 4,539,018 | 9/1985 | Whanger et al. | 51/295 |
| 4,604,106 | 8/1986 | Hall et al. | 175/434 X |
| 4,605,343 | 8/1986 | Hibbs, Jr. et al. | 175/434 |
| 4,811,801 | 3/1989 | Salesky et al. | 175/433 |
| 4,974,498 | 12/1990 | Lemelson | 92/223 |
| 5,040,501 | 8/1991 | Lemelson | 123/188 AA |
| 5,049,164 | 9/1991 | Horton et al. | 51/295 |
| 5,135,061 | 8/1992 | Newton, Jr. | 175/428 |
| 5,255,929 | 10/1993 | Lemelson | 280/11.18 |
| 5,335,738 | 8/1994 | Waldenstrom et al. | 175/434 |
| 5,355,750 | 10/1994 | Scott et al. | 76/108.2 |
| 5,370,195 | 12/1994 | Keshavan et al. | 175/428 X |
| 5,447,208 | 9/1995 | Lund et al. | 175/428 |

FOREIGN PATENT DOCUMENTS

| | | | |
|---|---|---|---|
| 0546725 | 6/1993 | European Pat. Off. . | |
| 2216929 | 10/1989 | United Kingdom | 175/428 |
| 2261894 | 6/1993 | United Kingdom . | |
| 2282833 | 4/1995 | United Kingdom . | |

*Primary Examiner*—Hoang C. Dang
*Attorney, Agent, or Firm*—Christie, Parker & Hale, LLP

[57] ABSTRACT

A polycrystalline diamond cutter having a coating of refractory material applied to the polycrystalline diamond surface increases the operational life of the cutter. The coating typically has a thickness in the range of from 0.1 to 30 $\mu$m and may be made from titanium nitride, titanium carbide, titanium carbonitride, titanium aluminum carbonitride, titanium aluminum nitride, boron carbide, zirconium carbide, chromium carbide, chromium nitride, or any of the transition metals or Group IV metals combined with either silicon, aluminum, boron, carbon, nitrogen or oxygen. The coating can be applied using conventional plating or other physical or chemical deposition techniques.

21 Claims, 3 Drawing Sheets

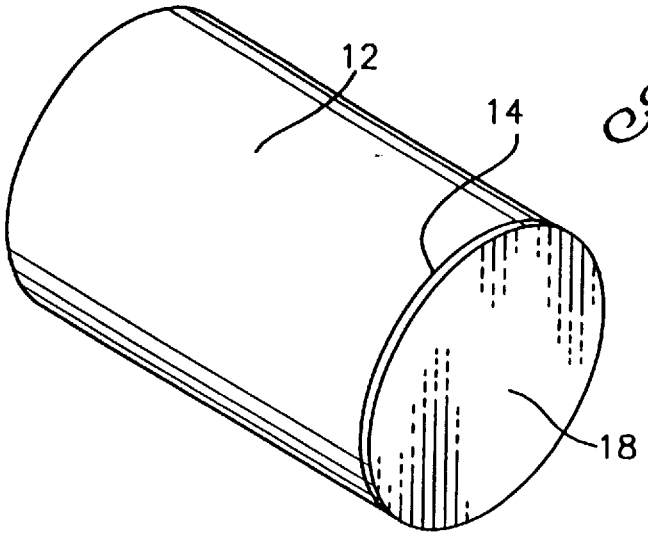
Fig. 1
Fig. 2
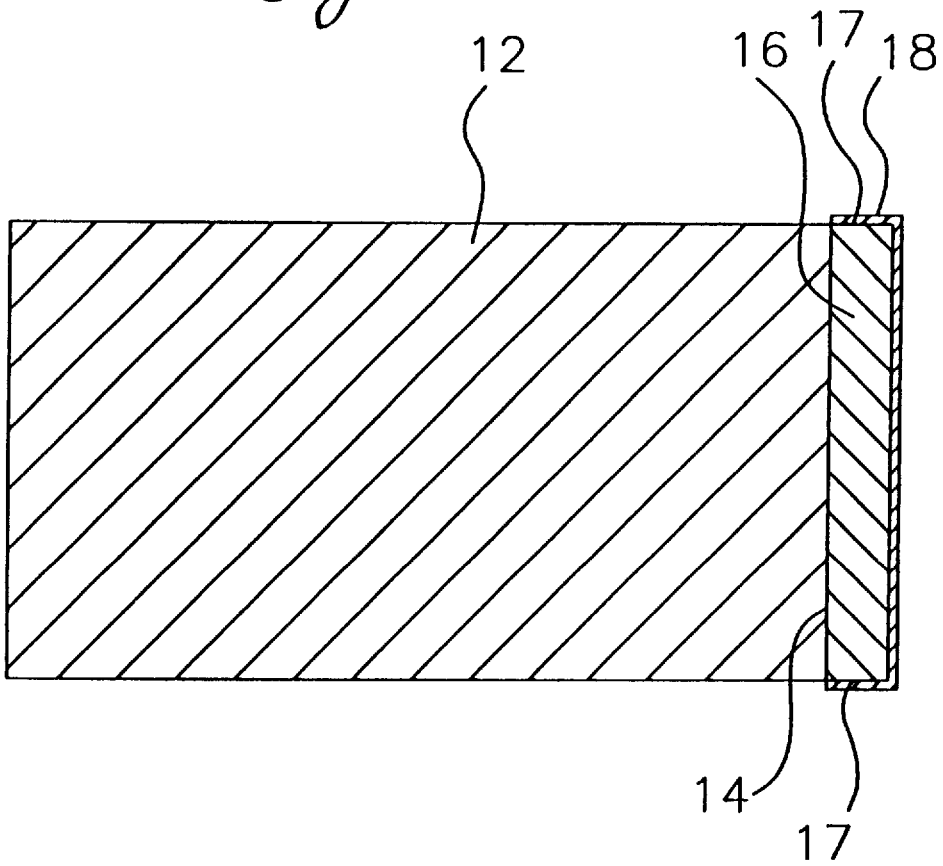

23
22
21

SURFACE ENHANCED POLYCRYSTALLINE DIAMOND COMPOSITE CUTTERS

BACKGROUND OF THE INVENTION

The present invention relates to polycrystalline diamond (PCD) and polycrystalline cubic boron nitride (PCBN) cutters used in drag bits for drilling bore holes in earth formations. More specifically, the present invention relates to coatings of refractory materials which are applied to the PCD or PCBN surface of the cutter to enhance the cutter's operating life. The invention is also applicable to other cutters having a hard surface similar to diamond. For descriptive simplification, reference is made herein to PCD cutters. However, PCD as used herein specifically refers to PCD or PCBN as well as any other material which is similar to diamond.

PCD cutters are well known in the art. They have a cemented tungsten carbide body and are typically cylindrical in shape. The cutting surface of the cutter is formed by sintering a PCD layer to a face of the cutter. The PCD layer serves as the cutting surface of the cutter. The cutters are inserted in a drag bit body which is rotated at the end of a drill string in an oil well or the like for engaging the rock formation and drilling the well.

Typically, the cutter makes contact with a rock formation at an angle and as the bit rotates, the PCD cutting layer makes contact and cuts away at the earth formation. This contact causes surface abrasive and thermal wear leading to the erosion or breakage of the PCD surface resulting in the eventual failure of the cutter. Moreover, during drilling the PCD surface is exposed to an environment which corrodes and wears away the cobalt phase of the PCD. This wear is commonly referred to as chemical wear. As the cobalt phase of the PCD corrodes and wears away, the PCD surface becomes very brittle, and breaks, leading to cutter failure. When multiple cutters fail, the drilling operation is ceased, the bit is removed from the bore hole, and the bit is replaced. This stoppage in operation adds to the cost of drilling.

Accordingly, there is a need for PCD cutters with increased PCD wear, erosion and impact resistance, as well as cobalt phase corrosion resistance. Such cutters will have enhanced useful lives resulting in higher rate of penetration, longer bit life, less frequent bit changes and in fewer drilling operation stoppages for replacing a bit having failed cutters.

SUMMARY OF THE INVENTION

A polycrystalline diamond or a polycrystalline cubic boron nitride drag bit cutter has a coating of refractory material applied to the PCD surface for enhancing the operational life of the PCD cutter. A coating having typically a thickness within the range of from 0.1 to 30 $\mu$m is applied to the PCD cutting surface. Typical coatings comprise titanium nitride, titanium carbide, titanium carbonitride, titanium aluminum carbonitride, titanium aluminum nitride, boron carbide, chromium carbide, chromium nitride, zirconium carbide, or any of the transition metals or Group IV metals combined with either silicon, aluminum, carbon, boron, nitrogen or oxygen. The coating can be applied using conventional plating techniques, or a chemical vapor deposition, metal organic chemical vapor deposition, physical vapor deposition techniques, plasma vapor deposition, sputtering, vacuum deposition, arc process or a high velocity spray process.

BRIEF DESCRIPTION OF THE DRAWINGS

FIG. 1 is an isometric view of a PCD cutter with a coating of refractory material applied over the PCD layer.

FIG. 2 is a longitudinal cross-sectional view of the PCD cutter depicted in FIG. 1.

DETAILED DESCRIPTION

In reference to FIGS. 1 and 2 a polycrystalline diamond (PCD) cutter is formed having an enhanced operational life for use in drag bits. As described above, PCD as used herein specifically refers to PCD or polycrystalline cubic boron nitride (PCBN) as well as any other material which is similar to diamond.

Figure 4:
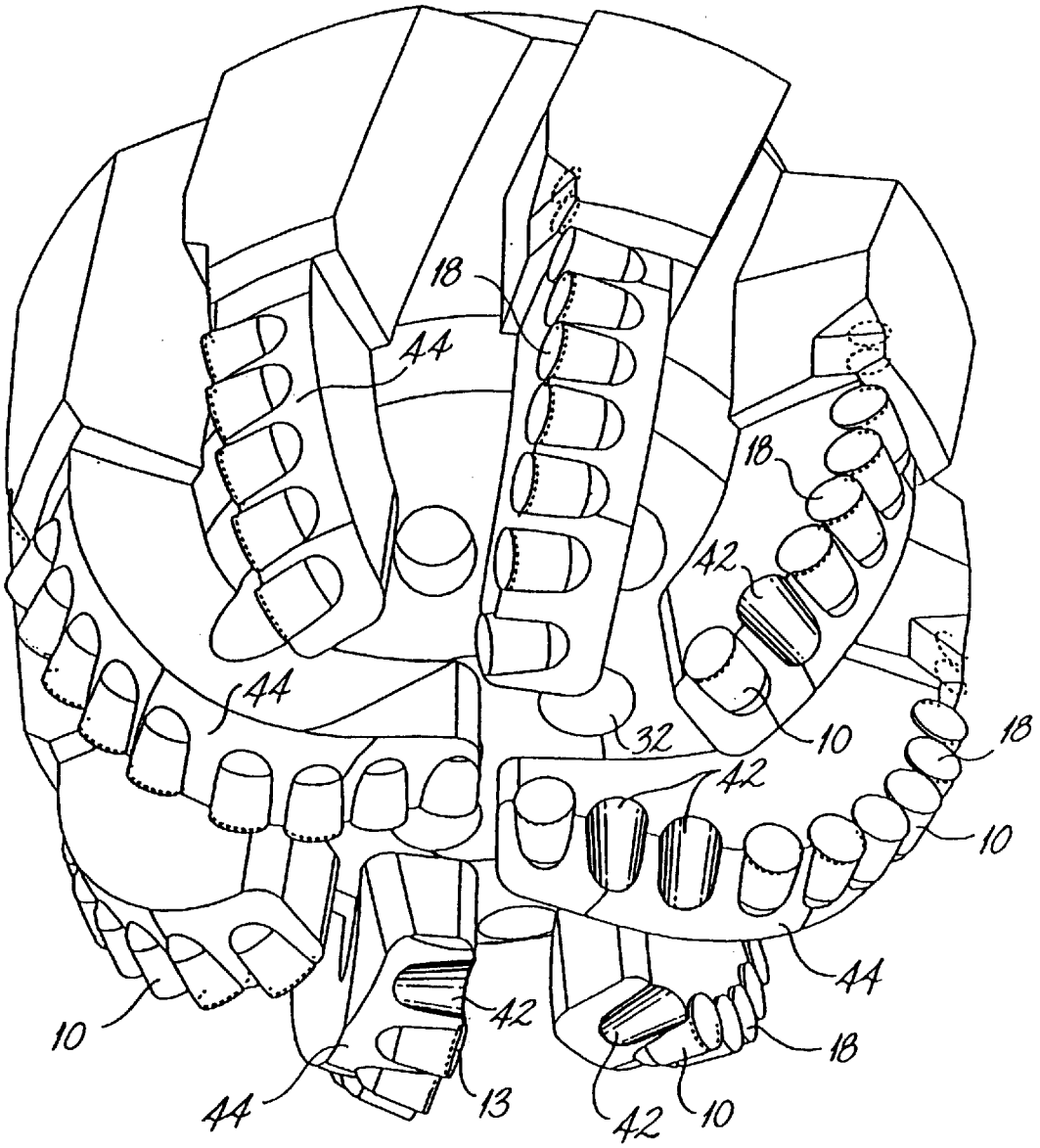
FIG. 4 is an isometric view of a drag bit with some installed PCD cutters coated with a refractory material.

A typical drag bit body, shown in FIG. 4, has a plurality of openings 42 formed on faces 44 to accept a plurality of PCD cutters 10. The bit body is fabricated from either steel or a hard metal "matrix" material. The matrix material is typically a composite of macrocrystalline or cast tungsten carbide infiltrated with a copper base binder alloy. Exemplary PCD cutters have a generally cylindrical carbide body 12 having a cutting face 14 (FIGS. 1 and 2). A PCD layer 16 is sintered on the cutting face of the cutter in a conventional manner. The PCD layer 16 shown in FIG. 2 has square edges 17. However, some PCD layers may have bevelled edges. The PCD layer forms the cutting surface of the PCD cutter, i.e., the surface that comes in contact with the earth formation or rock and cuts away at it. With use, the PCD erodes or chips due to impact and contact with the earth formations.

To prolong the life of these cutters, a coating 18 of refractory material is applied to the PCD surface. It should be apparent that the layer illustrated in FIG. 2 is exaggerated in thickness for purposes of illustration and in practice is extremely thin. For some operations, the coating need only be applied to the PCD surfaces that would come in contact with the earth formations. It may be sufficient, for example, to apply the coating only to the front face of the PCD layer, or maybe only to a portion of the face and the edges of the PCD layer. However, it may be easier to apply the coating to all of the exposed PCD surfaces as shown in FIGS. 1 and 2. When a cutter has a beveled or chamfered edge, the beveled edge is also coated. The coatings render lubricity and luster to the PCD surface.

Typical coatings which may be used are made from titanium nitride (TiN), titanium carbide (TiC), titanium carbonitride (TiCN), titanium aluminum carbonitride (TiAlCN), titanium aluminum nitride (TiAlN), boron carbide ($B_4C$), chromium nitride, (CrN), chromium carbide (CrC), zirconium carbide (ZrC) or any of the transition metals or Group IV metals combined with silicon, aluminum, boron, carbon, nitrogen or oxygen forming a silicide, aluminide, boride, carbide, nitride, boride, oxide or carbonitride of a metal.

Many of these compounds, such as TiCN or TiAlCN, are not stoichiometric compounds. For example, TiCN is essentially part of a continuum of compositions ranging from titanium carbide to titanium nitride. Similarly, the proportion of aluminum in TiAlCN may vary all the way to zero. Also, these compounds may be sub stoichiometric, for example, having excess metal below the stoichiometric amount.

The coating may be made with more than one material. For example, it appears that a desirable coating may have a first layer of titanium nitride and a second overlying layer of titanium carbonitride.

Aluminum oxide, magnesium oxide, silicon oxide and other refractory oxides may also be used as coatings for the PCD surface. Oxygen bonds to diamond surfaces for good adhesion of such materials. Generally, carbides, nitrides, and carbonitrides are preferred for the coating. Such materials have an affinity for the diamond surface and adhere well.

For better adhesion of the coating to the PCD surface, the PCD surface may be pretreated. For example, this can be accomplished by selective etching of the metallic phase of the PCD surface, or by treating the surface with reactive metal, which can be accomplished using laser sputtering, or by ion bombardment or plasma etching the surface.

The coating can be applied using conventional electrolytic or electroless plating techniques, chemical vapor deposition (CVD), metal organic chemical vapor deposition (MOCVD), physical vapor deposition, plasma vapor deposition (PVD), sputtering, vacuum deposition, arc spraying process or a high velocity detonation spray process such as the process employed by the Super D-Gun. For example, an electron beam vacuum deposition process such as used by Balzers Tool Coating, Inc., in Rock Hill, S.C. is sufficient for applying a titanium nitride coating to the PCD surface. In such a process, the PCD is heated to a temperature of about 450° C. during deposition of the coating.

In cases where the difference in the coefficients of thermal expansion between the coating and the PCD surface is significant to cause thermal cracking of the coating, it may be desirable to apply an intermediate layer or a plurality of intermediate layers on the PCD surface having a coefficient of thermal expansion that lies between the coefficients of the PCD surface and the coating. As a result, a gradual variation in the coefficients is achieved from the PCD surface to the outermost coating, reducing the magnitude of the thermal stress build-up on the coating.

Alternatively, the coating may be applied such its coefficient of thermal expansion varies through its thickness. This can be accomplished by gradually changing the composition of the coating through its thickness during the coating application. For example, applying a TiC coating on the PCD surface and then gradually increasing the amount of nitrogen during the coating build-up, forming TiCN and eventually TiN. The TiC coefficient of thermal expansion does not differ significantly from that of the PCD layer. Another example comprises a gradual change of the coating composition from SiC to SiN.

The coating on the PCD surface may be applied after manufacturing the cutter or may be applied after a cutter is mounted in a drag bit. In the latter technique, such a coating may be applied over the surrounding steel or other material of the bit body as well as the cutting surface of the PCD. Coating the cutters after mounting in the bit body avoids the difficulties of brazing the cutters in place without damaging their thin coatings.

Preferably, the coating is applied only to the cutting face of inserts to be brazed into a bit body to avoid interference of the brazing by the coating which may not be wetted by some braze alloys. If the coating is applied prior to the brazing of the insert to the bit body, a protective refractory paint or "stop-off" may be applied over the coating. An exemplary paint is ceramic paint. These paints provide protection to the coating against the braze and oxidation due to the brazing process as well as prevent impact and the formation of local hot spots during the brazing process. After brazing, these paints can be easily removed, or they can be left on the coatings where they will be removed during the drilling process as the cutting surface engages the earth formations.

If the coating is applied prior to brazing, it is recommended that a coating such as $B_4C$, CrN or TiAlN is used because of its thermal stability at brazing temperatures.

Preliminary testing has shown that coatings having a thickness of 2 $\mu$m or less are sufficient. However, coatings having a total thickness ranging from about 0.1 to 30 $\mu$m can also be used. Preferably, coatings having a thickness up to about 6 $\mu$m are used. Reduction of balling of the cut earth formations and thermal wear on the cutter can be achieved by reducing the coefficient of friction or by decreasing the roughness of the coating. This can be accomplished by lapping the coating to a finish of 0.5 $\mu$m RMS or less. This type of finish typically requires that approximately 1 to 3 $\mu$m of material is lapped off. Lowered coefficient of friction lowers the sliding force of rock particles across the face of the cutter, thereby reducing cutting forces and surface heating. Reduced localized heating during use of the cutter may prevent localized heating, thermal cracking and delamination.

Two tests are typically used to ascertain the life of a PCD cutter. One of these tests is the milling impact test. In this test, a ½ inch (13 mm) diameter circular cutting disk is mounted on a fly cutter for machining a face of a block of Barre granite. The fly cutter rotates about an axis perpendicular to the face of the granite block and travels along the length of the block so as to make a scarfing cut in one portion of the revolution of the fly cutter. This is a severe test since the cutting disk leaves the surface being cut as the fly cutter rotates and then encounters the cutting surface again during each revolution.

In an exemplary test, the fly cutter is rotated at 2800 RPM. The cutting speed is 1100 surface feet per minute (335 MPM). The travel of the fly cutter along the length of the scarfing cut is at a rate of 50 inch per minute (1.27 MPM). The depth of the cut, i.e., the depth perpendicular to the direction of travel, is 0.1 inch (2.54 mm). The cutting path, i.e., offset of the cutting disk from the axis of the fly cutter is 1.5 inch (3.8 cm). The cutter has a back rake angle of 10°.

With this test, a measurement is made of how many inches of the granite block is cut prior to failure of the cutter. A cutter without a coating was tested and cut 83 inches (210 cm) prior to failing. Three similar cutters had their PCD surfaces coated with 2 $\mu$m of TiN and were tested. Each of the coated cutters cut approximately 95 inches (241 cm) of the granite block prior to failing, an increase of about 15%, indicating increased fracture toughness or breakage resistance of the coated cutter.

Another test that is used to assess the life of the cutter is the granite log abrasion test which involves machining the surface of a rotating cylinder of Barre granite. In an exemplary test, the log is rotated at an average of 630 surface feet per minute (192 MPM) past a ½ inch (1.3 mm) diameter cutting disk. There is an average depth of cut of 0.02 inch (0.5 mm) and an average removal rate of 0.023 $inch^3$/second (0.377 $cm^3$/second). The cutting tool has a back rake angle of 15°.

To assess the cutter, one determines a wear ratio of the volume of log removed relative to the volume of cutting tool removed. While the coated cutters have not been tested using the log abrasion test, it is expected that these tests will reveal similarly improved cutter wear resistance with the coated PCD cutters.

Figure 3:
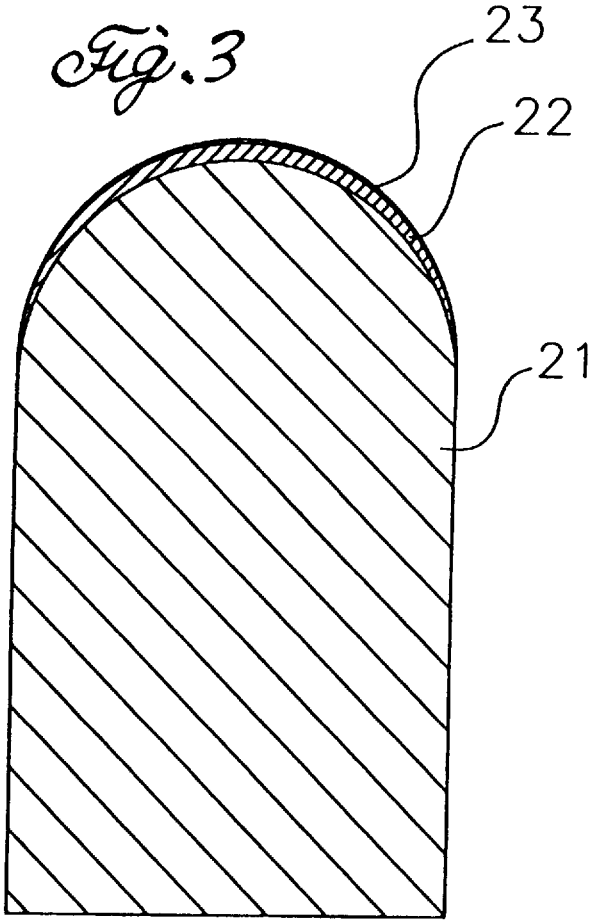
FIG. 3 is an exemplary insert for a rolling cone rock bit enhanced with a layer of polycrystalline diamond and coated with a thin layer of a refractory material.

Improved toughness of a carbide body with a PCD layer and a coating of refractory material is also desirable for inserts for conventional rolling cone rock bits. Such an insert is illustrated in longitudinal cross section in FIG. 3. The insert comprises a cylindrical body 21 of cemented tungsten carbide. One end of the body is hemispherical or may have other convex shapes such as a cone, chisel or the like conventionally used in rock bits. The convex end of the body has a layer 22 of polycrystalline diamond applied by conventional high pressure, high temperature processing. After the diamond layer is applied, a thin layer 23 of refractory material is applied over the PCD.

Such an insert is mounted in one of the cones of a rock bit and engages the rock formation as the cone rotates. Many of the inserts on a rock bit cone are subjected to significant impact loading and increased toughness is desirable. Such a coated enhanced insert is also useful in a rotary percussion bit where very large impact loads are common.

Although at the present time, the exact reasons are not known as to why coating the cutting surface with a coating of refractory material improves cutter life, several potential theories exist. It should be noted that the coating material is softer than the underlying diamond and, thus, hardness alone cannot explain the improvements. These theories are as follows.

1. There is a chemical interaction between the coating and the PCD surface resulting in an increased fracture toughness of the PCD cutting surface.

2. The coating acts as an impact absorption and transmitting media enhancing the fracture toughness and impact resistance of the PCD surface.

3. An intermediate layer is formed due to an interaction between the coating and the PCD layer.

4. The coating has a mechanical effect, i.e., it distributes the load over a wider area on the cutting surface, however, due to the thinness of the coating, this theory is not favored.

5. The coating reduces the friction on the cutting surface, thereby allowing for easier sliding of the rock chips away from the cutting surface and, thus, reducing balling.

6. The coating increases the corrosion resistance of the cobalt phase in the PCD, thus increasing the PCD resistance to chemical wear.

7. A thermal coefficient mismatch between the coating and the PCD surface produces a residual compressive stress, or in the alternative reduces the residual tensile stress, on the PCD surface, thus increasing the tensile strength of the PCD surface.

While any of these theories is plausible, it is also believed that the coating alters the chemical interaction between the mud/rock and the PCD layer resulting in the prolonged life of the PCD surface.

It is also anticipated that coating the surface of a cubic boron nitride cutter with a refractory material may improve its resistance to breakage.

Although this invention has been described in certain specific embodiments, many additional modifications and variations will be apparent to those skilled in the art. It is, therefore, understood that within the scope of the appended claims, this invention may be practiced otherwise than specifically described.

What is claimed is:

1. A polycrystalline diamond cutter comprising:

a cemented metal carbide body having a face;

a polycrystalline diamond layer on the body face wherein at least part of the polycrystalline diamond layer is used to engage earth formations; and a coating covering at least the part of the polycrystalline diamond face used to engage earth formations, the coating consisting essentially of a non-diamond refractory silicide, aluminide, boride, carbide, nitride, boride, oxide or carbonitride of a metal.

2. A polycrystalline diamond cutter as recited in claim 1 wherein the coating is selected from the group of non-diamond refractory metal compounds consisting of titanium nitride, titanium carbide, titanium carbonitride, titanium aluminum carbonitride, titanium aluminum nitride, boron carbide, chromium carbide, chromium nitride, zirconium carbide and any of the transition metals or Group IV metals combined with either silicon, aluminum, boron, carbon, nitrogen or oxygen.

3. A polycrystalline diamond cutter as recited in claim 1, wherein the coating comprises a Group IV element combined with an element selected from the group consisting of Si, Al, B, C, N and O.

4. A polycrystalline diamond cutter as recited in claim 1 wherein the coating is selected from the group consisting of boron carbide, titanium nitride and titanium carbonitride.

5. A polycrystalline diamond cutter as recited in claim 1, wherein the coating has a thickness in the range of from about 0.1 to 30 $\mu$m.

6. A polycrystalline diamond cutter as recited in claim 1, wherein the coating has a thickness of about 2 $\mu$m.

7. A polycrystalline diamond cutter as recited in claim 1 further comprising an intermediate layer between the coating and the polycrystalline diamond.

8. A polycrystalline diamond cutter as recited in claim 7 wherein intermediate layer has a coefficient of thermal expansion between the coefficients of expansion of the polycrystalline diamond layer and the coating.

9. A polycrystalline diamond cutter as recited in claim 1 wherein the coating has a composition that varies through its thickness for varying its coefficient of thermal expansion wherein the composition of the coating closest to the polycrystalline diamond layer has a coefficient of thermal expansion closest to that of the polycrystalline diamond layer.

10. A polycrystalline diamond cutter as recited in claim 1 wherein the coating has a surface finish of 0.5 $\mu$m RMS or less.

11. A polycrystalline diamond cutter as recited in claim 1 further comprising a layer of refractory paint on top of the coating.

12. A polycrystalline diamond cutter as recited in claim 1, wherein the polycrystalline diamond layer is applied in a high temperature, high pressure process and wherein the coating is applied to the face after the high temperature, high pressure process.

13. A polycrystalline diamond cutter as recited in claim 1, wherein the coating is applied to the face by a process selected from the group consisting of electrolytic or electroless plating, chemical vapor deposition, metal organic chemical vapor deposition, physical vapor deposition, plasma vapor deposition, sputtering, vacuum deposition, arc spraying and high velocity detonation spraying.

14. A polycrystalline diamond cutter as recited in claim 1, wherein the coating is applied to the face by an electron beam vacuum deposition process.

15. A polycrystalline diamond cutter as recited in claim 1 wherein the coating is selected from the group of non-diamond refractory metal compounds consisting of titanium nitride, titanium carbide, titanium carbonitride, titanium aluminum carbonitride, titanium aluminum nitride, boron carbide, chromium carbide, chromium nitride and zirconium carbide.

16. A polycrystalline diamond cutter comprising:

a cemented metal carbide body having a face;

a polycrystalline diamond layer on the body face wherein at least part of the polycrystalline diamond layer is used to engage earth formations; and a non-diamond refractory metal compound coating covering at least part of the polycrystalline diamond face used to engage earth formations and wherein the coating is substantially only applied to the face of the polycrystalline diamond layer used to engage earth formations.

17. A polycrystalline diamond cutter as recited in claim 16 wherein the coating is selected from the group of non-diamond refractory metal compounds consisting of titanium nitride, titanium carbide, titanium carbonitride, titanium aluminum carbonitride, titanium aluminum nitride, boron carbide, chromium carbide, chromium nitride and zirconium carbide.

18. A polycrystalline diamond cutter comprising:

a cemented metal carbide body having a face;

a polycrystalline diamond layer on the body face wherein at least part of the polycrystalline diamond layer is used to engage earth formations; and a coating on the polycrystalline diamond surface, wherein the polycrystalline diamond surface has a residual tensile stress and wherein the coating reduces the magnitude of the residual tensile stress.

19. A drill bit for cutting rock formations comprising:

a bit body; and a plurality of polycrystalline diamond cutters embedded in the bit body, each of the cutters comprising:

a cemented tungsten carbide body, a layer of polycrystalline diamond on a cutting face of the body, and a coating over the polycrystalline diamond, the coating consisting essentially of a non-diamond refractory metal compound selected from the group consisting of titanium nitride, titanium carbide, titanium carbonitride, titanium aluminum carbonitride, titanium aluminum nitride, boron carbide, chromium carbide, chromium nitride, zirconium carbide and any of the transition metals or Group IV metals combined with either silicon, aluminum, boron, carbon, nitrogen or oxygen.

20. A drill bit as recited in claim 19 wherein the refractory metal compound coating is selected from the group consisting of boron carbide, titanium nitride and titanium carbonitride.

21. A drill bit as recited in claim 19 wherein the polycrystalline diamond layer is applied in a high temperature, high pressure process and wherein the coating is applied to the face after the high temperature, high pressure process.

* * * * *